United States Patent [19]

Castonguay et al.

[11] Patent Number: 4,912,440

[45] Date of Patent: Mar. 27, 1990

[54] PROTECTIVE COATING ON ELECTRONIC CIRCUIT BREAKER COMPONENT

[75] Inventors: Roger N. Castonguay, Terryville; Trenton D. Masterson, Cheshire, both of Conn.

[73] Assignee: General Electric Company, New York, N.Y.

[21] Appl. No.: 337,727

[22] Filed: Apr. 13, 1989

[51] Int. Cl.[4] ..... H01H 9/20

[52] U.S. Cl. ..... 335/167; 335/27

[58] Field of Search ..... 335/27, 35, 37–78, 335/23–4, 45, 167–174; 148/6.16, 6.19 R

[56] References Cited

U.S. PATENT DOCUMENTS 3,953,812 4/1976 Heft et al. .
3,979,704 9/1976 Buckley et al. .
4,589,052 5/1986 Dougherty .
4,649,455 3/1987 Scott .
4,673,445 6/1987 Tuttle, Jr. et al. .
4,733,211 3/1988 Castonguay et al. .
4,736,174 4/1988 Castonguay et al. .
4,749,417 6/1988 Tuttle, Jr. et al. .
4,782,583 11/1988 Castonguay et al. .
4,789,848 12/1988 Castonguay et al. .
4,794,356 12/1988 Yu et al. .
4,806,893 2/1989 Castonguay et al. .

*Primary Examiner*—Leo P. Picard
*Assistant Examiner*—Lincoln Donovan
*Attorney, Agent, or Firm*—Richard A. Menelly; Walter C. Bernkopf; Fred Jacob

[57] ABSTRACT

Electronic circuit breaker components are selectively coated with zinc and tin compounds to protect the components from the environment and to promote lubricity. Selected components within the operating mechanism, actuator and crossbar assemblies are coated with zinc phosphate followed by an over-coating of tin phosphate.

13 Claims, 4 Drawing Sheets

PROTECTIVE COATING ON ELECTRONIC CIRCUIT BREAKER COMPONENT

BACKGROUND OF THE INVENTION

Electric circuit breakers must subscribe to rigid industrial specifications and requirements to insure operation under extreme atmospheric conditions. To insure release of the circuit breaker operating mechanism during a tripping function, the circuit breaker latch and cradle assemblies are coated with a lubricating grease. Other circuit breaker components are coated with an insulative material to deter the transfer of circuit current other than through the circuit breaker contacts.

U.S. Pat. No. 3,953,812 teaches insulative material such as phosphate, silicon, varnish and the like to prevent the transfer of current between the circuit breaker cradle and armature.

U.S. Pat. No. 3,979,704 discloses that zinc phosphate and zinc chromate coatings should be applied to circuit breaker components when the circuit breaker is immersed in the liquid dielectric contained within a distribution transformer. The zinc phosphate and zinc chromate coatings protect the circuit breaker components from chemically reacting with the dielectric without interfering with the motility of the components.

When a circuit breaker employs a self-contained electronic trip unit, an actuator unit is required to interface between the circuit breaker operating mechanism and the trip unit in order to separate the circuit breaker contacts upon the occurrence of pretermined overcurrent conditions. U.S. Pat. No. 4,806,893, which Patent is incorported herein for purposes of reference, describes one such actuator unit.

U.S. Pat. Nos. 4,789,848 and 4,736,174 describe the latching and operating mechanisms used within the aforementioned U.S. Pat. No. 4,806,893 and are incorporated herein for purposes of reference. Both of these Patents should be reviewed for their description of the interaction between the motile circuit breaker components.

U.S. Pat. Nos. 4,733,211 and 4,782,583 describe the crossbar assembly that interfaces between the circuit breaker movable contact arm and the operating mechanism. Both of these Patents are also incorporated herein for reference purposes.

The components within the latching, operating mechanism and crossbar assemblies that slidingly interface with each other are each selectively coated to reduce the coefficient of friction inparted to these components by the loading provided by the powerful operating springs contained within the operating mechanism assembly and to protect the components from reacting with the environment. When such components are previously coated with zinc or tin compounds in accordance with the prior art, the zinc or tin material must first be selectively removed from the areas of those components that are to be coated with a lubricating grease to maintain a low coefficient of friction and protect the areas from the environment. The coatings are removed to prevent the "galling" of the materials used to form the coatings, which occurs when the materials are subjected to the loading provided by the operating springs. The galling could substantially increase the coefficient of friction and interfere with the operation of the components. The selective removal of the zinc or tin coating is economically infeasible when such circuit breaker components are robotically assembled.

The moving components that form part of the actuator unit described in aforementioned U.S. Pat. No. 4,806,893 should also be coated to provide a low coefficient of friction and to prevent oxidation. Because of the small size of these components, the removal of the protective coating is also economically infeasible.

The present invention accordingly, describes compositions for coating selected circuit breaker components without requiring removal of the coating and substituting the coating with lubricating grease.

SUMMARY OF THE INVENTION

The slidingly interactive parts of a circuit breaker operating mechanism, latching assembly, crossbar and actuator are first coated with a zinc phosphate composition followed by a second coating that includes tin phosphate. Lubricating grease can optionally be applied to the coated parts without first removing the tin and zinc phosphate materials.

DESCRIPTION OF THE PREFERRED EMBODIMENT

Figure 1:
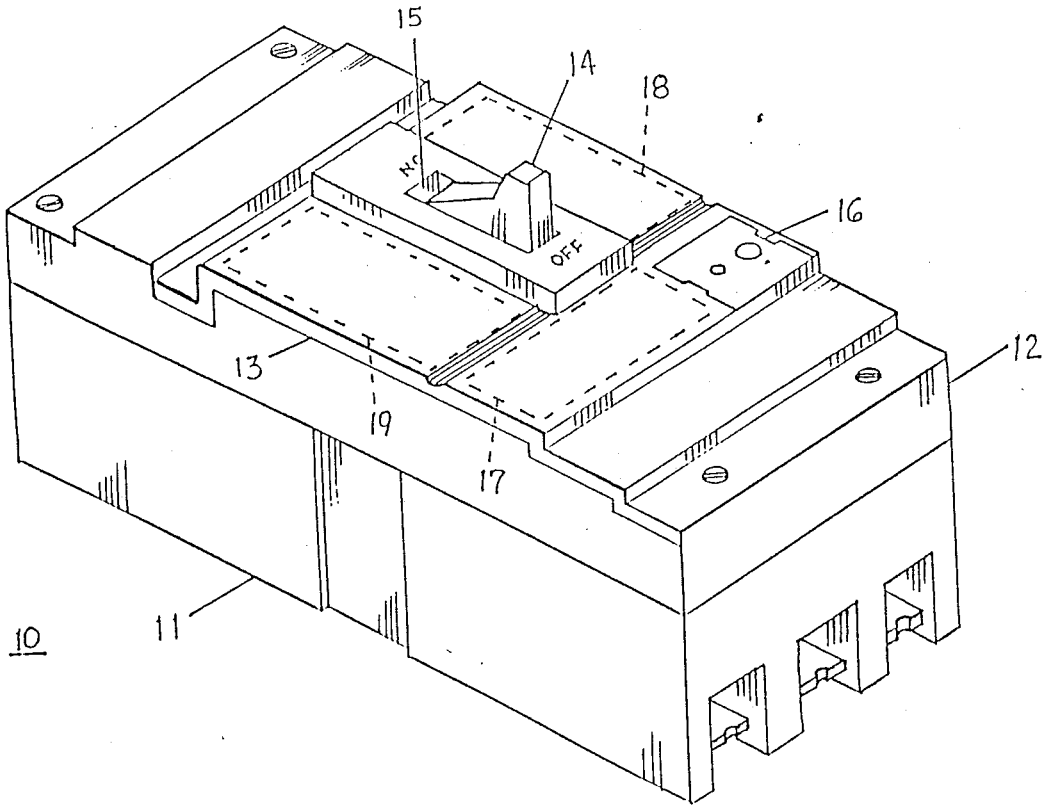
FIG. 1 is a top perspective view of a circuit breaker employing components that are coated in accordance with the invention.

An electronic circuit breaker 10 as shown in FIG. 1 includes a molded plastic case 11 to which a molded plastic cover 12 is attached along with an accessory cover 13. As described in aforementioned U.S. Pat. No. 4,806,893, a circuit breaker operating handle 14 extends through a slot 15 formed in the circuit breaker cover for manual intervention to turn the circuit breaker between its "ON" and "OFF" conditions. A rating plug 16 which is described within U.S. Pat. No. 4,649,455, interconnects with the electronic trip unit printed wiring board 17, such as described in U.S. Pat. No. 4,589,052, both Patents being incorporated herein for reference purposes. The actuator unit 18 which is described within aforementioned U.S. Pat. No. 4,806,893 is contained within the circuit breaker cover 12 under the accessory cover 13. An auxiliary switch unit 19 such as described within U.S. Pat. No. 4,794,356 is contained within the circuit breaker cover under the accessory cover and on the opposite side of the circuit breaker operating handle 14.

Figure 2:
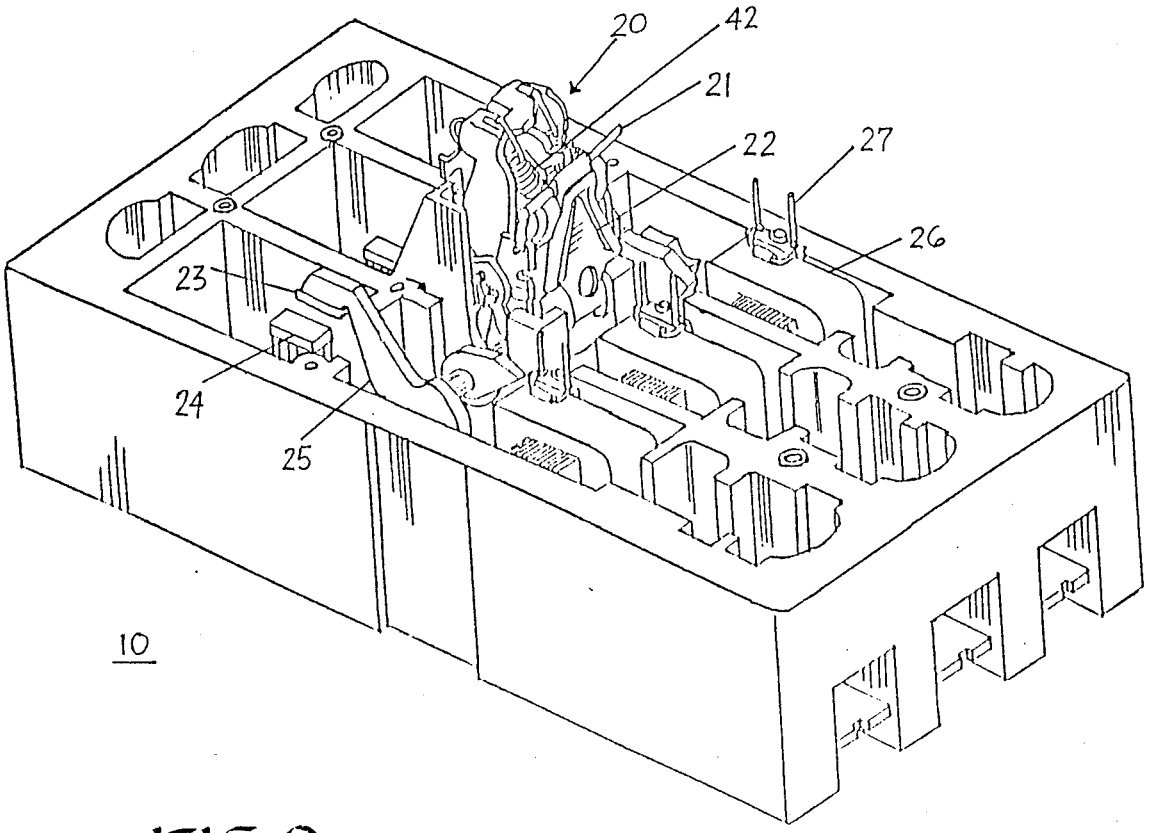
FIG. 2 is a top perspective view of the circuit breaker of FIG. 1 with the circuit breaker cover and accessory cover removed to display the coated components contained therein.

In operation, the circuit current is sensed within three current transformers 26, shown in the circuit breaker 10 depicted in FIG. 2, which connect with the trip unit printed wire board by means of pin connectors 27. The interconnect arrangement between the current transformers and the printed wire board is described within U.S. Pat. Application Ser. No. 299,179 filed Jan. 18, 1989 entitled "Molded Case Circuit Breaker Current Transformer Assembly". The circuit current is processed within the trip unit contained within the printed wire board and the operating mechanism 20 becomes articulated to interrupt the circuit current when the circuit current exceeds predetermined levels for predetermined time periods. The actuator (FIGS. 3 and 7) interacts with the operating mechanism upon displacement of the trip bar 21 and the attached latch assembly 22 thereby releasing the powerful operating mechanism springs 42, which in turn, drive the movable contact arms 25 to the open position breaking electrical contact between the movable contacts 23 and the fixed contacts 24 to rapidly interrupt the circuit current.

Figure 3:
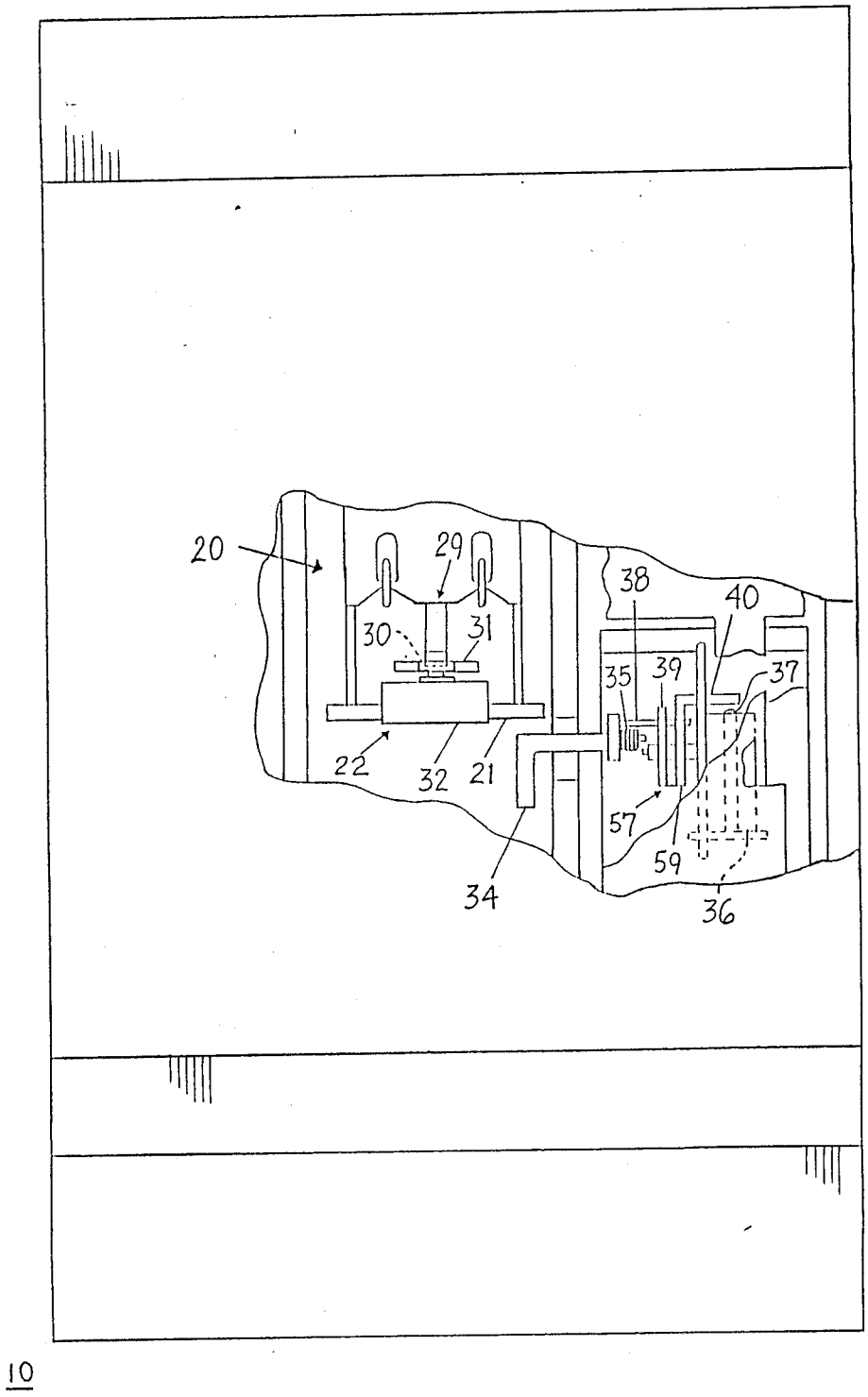
FIG. 3 is a plan view of the circuit breaker of FIG. 1 with part of the accessory cover and circuit breaker cover removed to depict the interaction between the components contained therein.

The interaction between the operating mechanism 20 and the trip actuator 57 is best seen by referring now to the circuit breaker 10 shown in FIG. 3. The cradle assembly 29 within the operating mechanism assembly 20 restrains the operating mechanism by trapping the cradle hook 30 under the primary latch 31. Release of the cradle assembly is accomplished by first releasing the secondary latch 32 within the latch assembly 22 by contact between the trip bar 21 within the latch assembly 22 and the trip lever 34 extending from the trip actuator 57. The trip lever is restrained from contacting the trip bar under the urgence of the trip spring 35 by engagement between the trip lever 39 and the latch pin 38, as indicated. The trip unit, described earlier, energizes the trip coil 36 upon the occurrence of an overcurrent condition which releases the trip plunger 37 into contact with the latch plate 40. The latch lever 39 correspondingly rotates to release the latch pin 38 and thereby allow the trip lever 34 to contact the trip bar 21 and release the latch assembly 22.

Figure 4:
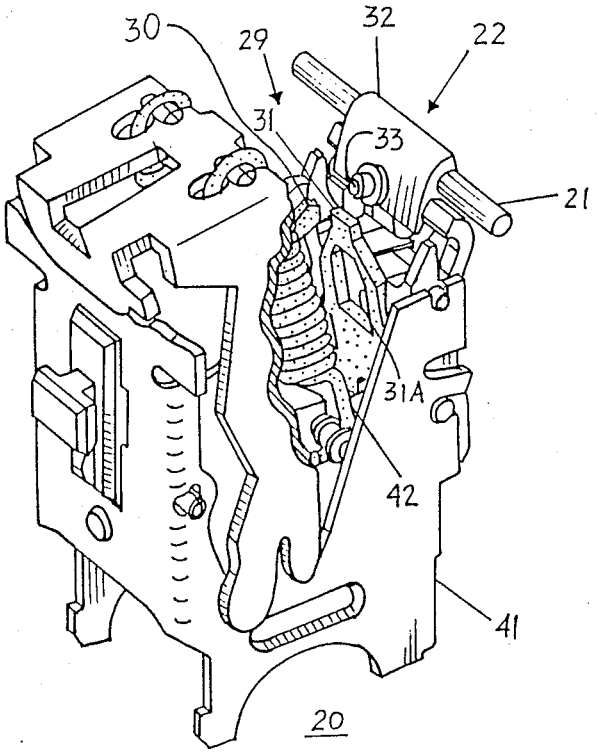
FIG. 4 is an enlarged top perspective view of the operating mechanism depicted in FIG. 2.

The operating mechanism 20 and latch assembly 22 are depicted in FIG. 4 in order to detail the selective components that are coated with zinc phosphate and tin phosphate to deter oxidation while providing lubricity between the coated parts. The tin phosphate coating being applied over the zinc phosphate by the methods described within U.S. Pat. Nos. 4,673,445 and 4,749,417. The operating mechanism 20 is supported within a continuous side frame 41 that supports the powerful operating springs 42. The operating springs are first coated with zinc phosphate by submersion within an electroless zinc phosphate coating solution followed by plating within a tin phosphate solution. The cradle assembly 29 is similarly plated with the zinc phosphate and tin phosphate coating as is the primary latch 31 wherein the opening 31A is defined for retaining the cradle hook 30 at the end of the cradle assembly 29. The trip bar 21, secondary latch 32 and secondary latch pin 33 are left uncoated.

Figure 5:
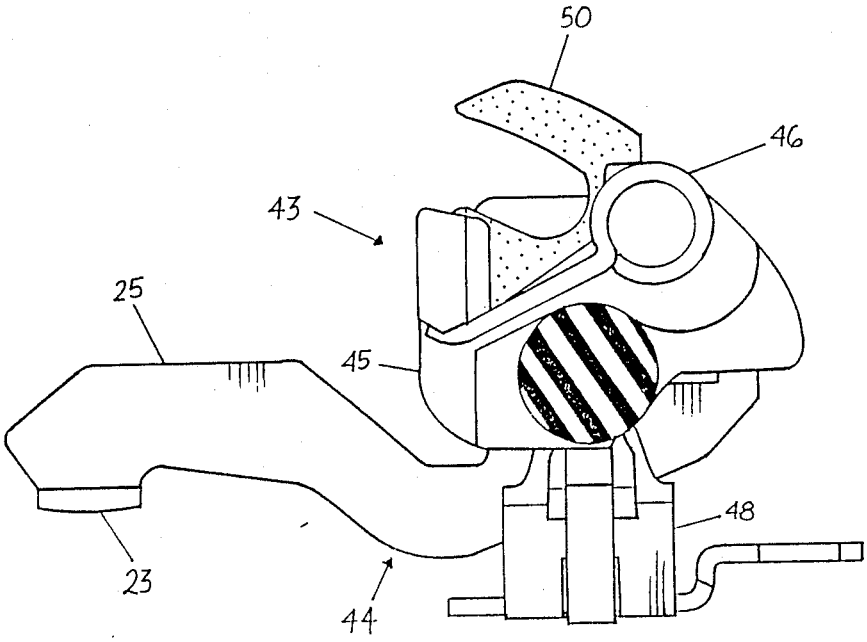
FIG. 5 is an enlarged side view of the crossbar and movable contact arm assembly depicted in FIG. 2.
Figure 6:
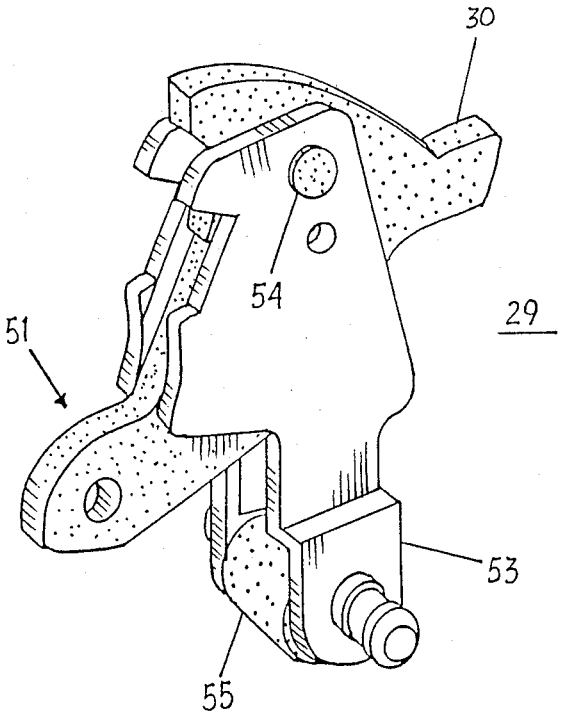
FIG. 6 is an enlarged side perspective view of the cradle assembly contained within the operating mechanism of FIG. 4.

A movable contact arm assembly 44 is shown in FIG. 5 attached to the crossbar assembly 43. The movable contact arm assembly includes the movable contact arm 25 and the movable contact 23. The movable contact arm is pivotally attached to the movable contact arm support 48. The crossbar 45 as described in aforementioned U.S. Pat. Nos. 4,733,211 and 4,782,583 includes a contact spring 46 to hold the movable contact 23 in good electrical contact with the fixed contact 24 (FIG. 2) during quiescent current conditions. The cam member 50 on the crossbar assembly interconnects the crossbar assembly with the operating mechanism assembly 20 (FIG. 4) by capturing the roller 55 shown pivotally supported between a pair of side plates 53 on the cradle assembly 29 shown in FIG. 6. The cam 50 (FIG. 5) is coated with zinc phosphate and tin phosphate. Still referring to FIG. 6, the cradle assembly 29 consists of a shaped cradle operator 51, which includes the cradle hook 30, and is attached to the side plates 53 by means of a pin 54. The pin 54 and the roller 55 are all coated with zinc phosphate and tin phosphate.

Figure 7:
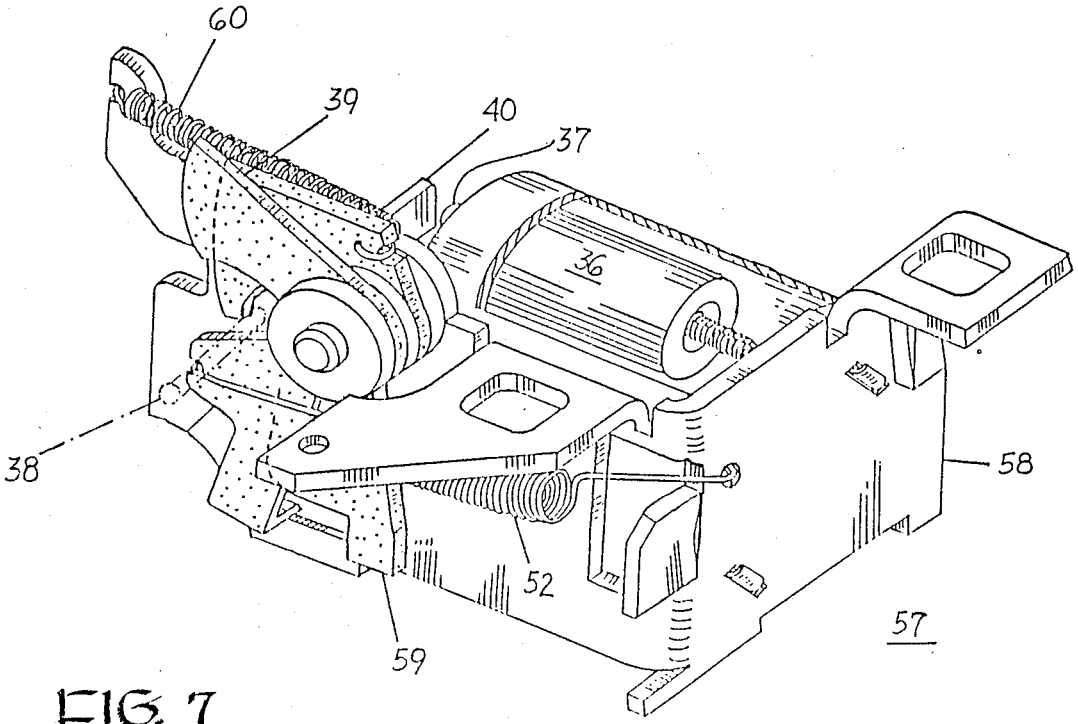
FIG. 7 is an enlarged top perspective view of the actuator depicted in FIG. 3.

The trip actuator 57 described earlier with reference to FIG. 3 is shown in FIG. 7 to include a single side frame 58 upon which the trip coil 36, latch lever 39, reset lever 59, reset spring 52 and latch reset spring 60 are supported. Whereas the latch lever 39 and reset lever 59 are zinc phosphate and tin phosphate coated, the trip plunger 37, latch plate 40, reset spring 52 and return spring 60 are left uncoated.

Comparing FIGS. 3 and 7, it is important to note that while the latch lever 39 and reset lever 59 are coated with zinc phosphate and tin phosphate, the latch pin 38 is left uncoated. As described earlier, the circuit breaker operating springs 42 (FIG. 4) exert a substantial force which generates substantial friction between the peripheral components that movingly interact with the operating mechanism components. The trip spring 35 that biases the latch pin 38 against the latch lever 39, exerts a force of less than one ounce such that the friction between the latch pin and the latch lever is relatively light. When selected operating mechanism and crossbar components are coated with the zinc phosphate and tin phosphate and lubricating grease is later optionally applied, it is noted that the zinc phosphate and tin phosphate coatings gradually wear in a smooth, continuous manner during long test periods of continuous tripping operations. The friction between the coated components instead of increasing upon continued operation, actually decreases. The beneficial decrease in friction is believed due to the ability of the zinc phosphate and tin phosphate coatings to wear away without leaving a pitted or galled surface such as occurs when the component parts are plated with the zinc and tin metals, per se. It is believed that the uniform continuously smooth wearing of the zinc phosphate and tin phosphate coating is due to the structure of the zinc phosphate and tin phosphate molecules.

It has thus been shown that beneficial protective coatings of zinc phosphate and tin phosphate can be applied to selective components within a molded case electric circuit breaker without interferring with the long term operation of the circuit breaker.

Having thus described our invention, what we claim as new and desire to secure by Letters Patent is:

1. A molded case circuit interrupter comprising in combination:

a molded plastic circuit breaker case and cover;

a fixed and a movable contact within said case and arranged for separation upon occurrence of an overcurrent condition through said contacts;

an operating mechanism coupled with said movable contact through a movable contact arm assembly for moving said movable contact arm and said movable contact to an open circuit position upon release of a pair of operating springs;

a latch assembly including a primary latch and a secondary latch, said primary latch interacting with said operating mechanism through a cradle assembly to deter release of said operating springs until said overcurrent condition persists for a predetermined period of time; and a trip actuator under control of a trip unit to impact said latch assembly to release said cradle assembly from said primary latch upon receipt of a trip signal from said trip unit, said primary latch being coated with zinc phosphate and tin phosphate.

2. The molded case circuit interrupter of claim 1 including a crossbar assembly arranged on said movable contact arm assembly and including a contact spring holding said movable contact in electrical connection with said fixed contact under quiescent current conditions through said fixed and movable contacts and an arcuate cam member, said arcuate cam member being coated with zinc phosphate and tin phosphate.

3. The molded case circuit interrupter of claim 2 wherein said cradle assembly includes a pair of opposing side plates, a cradle operator supporting said side plates by means of a pivot pin, said cradle operator and said pivot pin being coated with zinc phosphate and tin phosphate.

4. The molded case circuit interrupter of claim 3 including a roller rotatably supported intermediate said side plates, said roller being captured by said cam member causing said crossbar assembly and said cradle assembly to move in unison, said roller being coated with zinc phosphate and tin phosphate.

5. The molded case circuit interrupter of claim 2 wherein said trip actuator includes a trip lever and a reset lever, said reset lever being coated with zinc phosphate and tin phosphate.

6. The molded case circuit interrupter of claim 5 including a latch pin intermediate said trip lever and a latch lever retaining said trip lever against the bias of a trip spring, said latch lever being coated with zinc phosphate and tin phosphate.

7. The molded case circuit interrupter of claim 6 wherein said trip actuator includes an electromagnetic coil and a plunger and wherein said latch lever includes a latch plate, said electromagnetic coil receiving said trip signal from said trip unit thereby causing said plunger to impact said latch plate and release said latch pin from said latch lever.

8. The molded case circuit interrupter of claim 1 wherein said primary latch further includes a coating of lubricating grease.

9. The molded case circuit interrupter of claim 3 wherein said cradle operator further includes a coating of lubricating grease.

10. The molded case circuit interrupter of claim 4 wherein said roller further includes a coating of lubricating grease.

11. The molded case circuit interrupter of claim 5 wherein said reset lever further includes a coating of lubricating grease.

12. The molded case circuit interrupter of claim 6 wherein said latch lever further includes a coating of lubricating grease.

13. The molded case circuit interrupter of claim 12 wherein said arcuate cam member further includes a coating of lubricating grease.

* * * * *